United States Patent [19]

Weber

[11] 4,047,562

[45] Sept. 13, 1977

[54] HEAT EXCHANGER UTILIZING A VAPORIZED HEAT-CONTAINING MEDIUM

[75] Inventor: Max Weber, Wiesendangen, Switzerland

[73] Assignee: Sulzer Brothers Limited, Winterthur, Switzerland

[21] Appl. No.: 594,618

[22] Filed: July 10, 1975

[30] Foreign Application Priority Data

May 16, 1975 Switzerland ..... 6380/75

[51] Int. Cl.[2] ..... F28B 1/02

[52] U.S. Cl. ..... 165/111; 165/158; 165/163; 165/176; 165/72; 122/483

[58] Field of Search ..... 165/111, 113, 114, 158, 165/163, 176, 145, 72; 122/441, 483

[56] References Cited

U.S. PATENT DOCUMENTS

| | | | |
|---|---|---|---|
| 2,596,195 | 5/1952 | Arbuckle | 165/176 X |
| 2,774,575 | 12/1956 | Walter | 165/163 X |
| 3,675,710 | 7/1972 | Ristow | 165/111 X |
| 3,712,272 | 1/1973 | Carnavos et al. | 165/72 X |
| 3,759,319 | 9/1973 | Ritland et al. | 165/158 X |

FOREIGN PATENT DOCUMENTS

| | | | |
|---|---|---|---|
| 589,562 | 12/1933 | Germany | 122/483 |

*Primary Examiner*—Albert W. Davis, Jr.
*Attorney, Agent, or Firm*—Kenyon & Kenyon, Reilly, Carr & Chapin

[57] ABSTRACT

The end of the heat exchanger into which the vaporized heat-containing medium enters is divided into at least three chambers by partitions. The U-shaped tubes which pass the heat-containing medium into a heat exchange relation with a medium to be heated connect the three chambers sequentially in the flow path of the heat-containing medium but with a diminishing number of tubes connecting each sequential pair of chambers. The intermediate chambers allow the condensate formed by the heat-containing medium to be separated from the remaining vapor prior to passage of the vaporized medium into the next set of tubes.

9 Claims, 2 Drawing Figures

HEAT EXCHANGER UTILIZING A VAPORIZED HEAT-CONTAINING MEDIUM

Figure 2:
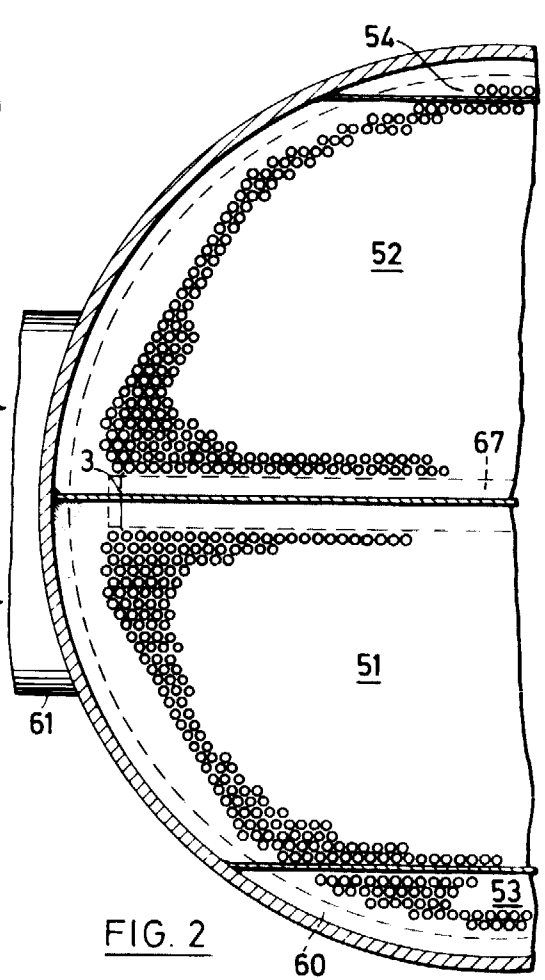

This invention relates to a heat exchanger and particularly to a heat exchanger which utilizes a vaporized heat-containing medium which condenses during heat exchange.

Heretofore, heat exchangers or heat-transmitters have been known in which a vaporous medium condenses while delivering heat to another medium. In some instances, these heat exchangers have a plurality of U-tubes which are connected to a common tube plate and arranged in at least one plane. In addition, a covering hood together with a partition extending at right-angles to the plane of the U-tubes have been used on the side of the tube plate opposite the tubes to define an inflow space and an outflow space for the heat-containing medium.

A heat-exchanger of this kind, in which steam is preferably used as a condensing medium can be used, for example as a steam-converter, as a feed-water preheater, or as reheater for partly-expanded steam. However, the heat-containing medium flowing in the U-tubes forms a condensate, which restricts the flow-through of the vaporous medium. This can lead to an unstable flow-distribution in the U-tubes. In order to avoid such an unstable phenomena, the heat-containing medium can be sent through the U-tubes in excess. However, the medium would then expand stagewise and as such produce losses.

Accordingly, it is an object of the invention to provide a low cost heat exchanger which is capable of using a vaporized heat-containing medium which undergoes condensation during a heat exchange operation.

It is another object of the invention to be able to provide a heat exchanger of simple construction which can efficiently use a vaporized medium for a heat-containing medium which is condensed in use.

It is another object of the invention to maintain a stable flow distribution in the tubes of a heat exchanger using a vaporized heat-containing medium.

It is another object of the invention to avoid a restriction of a vaporized heat-containing medium flowing through the tubes of a heat exchanger.

Briefly, the invention provides a heat exchanger wherein a tube plate separates two sections of the heat exchanger from each other with at least a pair of partitions in one of these sections to divide the section into at least three chambers. An inlet is provided to one of these chambers to deliver a vaporized heat-containing medium to the chamber while an outlet is provided to a second chamber to exhaust the medium therefrom in condensed form. The remaining chamber or chambers serve as intermediate chambers in the flow of the medium. A plurality of U-shaped tubes are mounted in the other section of the heat exchanger with their ends mounted on the tube plate so as to extend away from the chambers on the other side. A first set or portion of these tubes communicates the inlet chamber with an intermediate one of the chambers while a second set or portion of the tubes communicates the intermediate chamber with the outlet chamber. The sets of tubes are arranged so that the number of tubes in the second set is less than the number in the first set. This pattern of diminishing tubes for each successive chamber continues in heat exchangers having more than three chambers until the tube terminates in the outlet chamber.

The provision of the partitions and the stagewise reduction in the number of tubes connected to the individual chambers adapts the flow-section to the changes in volume of the heat-containing medium during operation. In addition, the condensate which is formed does not obstruct the flow of the remaining vaporized medium. In this way, a good flow-distribution of heat-containing medium to the U-shaped tubes is obtained without losing an excessive quantity of steam.

The heat exchanger is provided with a suitable housing which encases the tube plate and U-shaped tubes to form a compact unit. The housing is also equipped in known manner with suitable inlets and outlets for the introduction and exhaust not only of the heat-conducting medium but also of the medium to be heated. Further, each of the intermediate chambers between the inlet and outlet chambers in the flow path of the vaporized heat-containing medium is provided with an outlet, as the outlet chamber, in the lowest part in order to drain off condensate.

The heat exchanger is disposed on a horizontal axis so that the U-shaped tubes are horizontally disposed. This allows the medium condensed in the tubes to flow horizontally without significantly preventing the flow of the medium which remains in the vapor state.

The heat exchanger is moreover characterized by simple construction. The outlets of the U-shaped tubes into the tubesplate are quite accessible, so that in the event of leaks occurring, individual tubes can be put out of use - e.g. by plugging.

Figure 1:
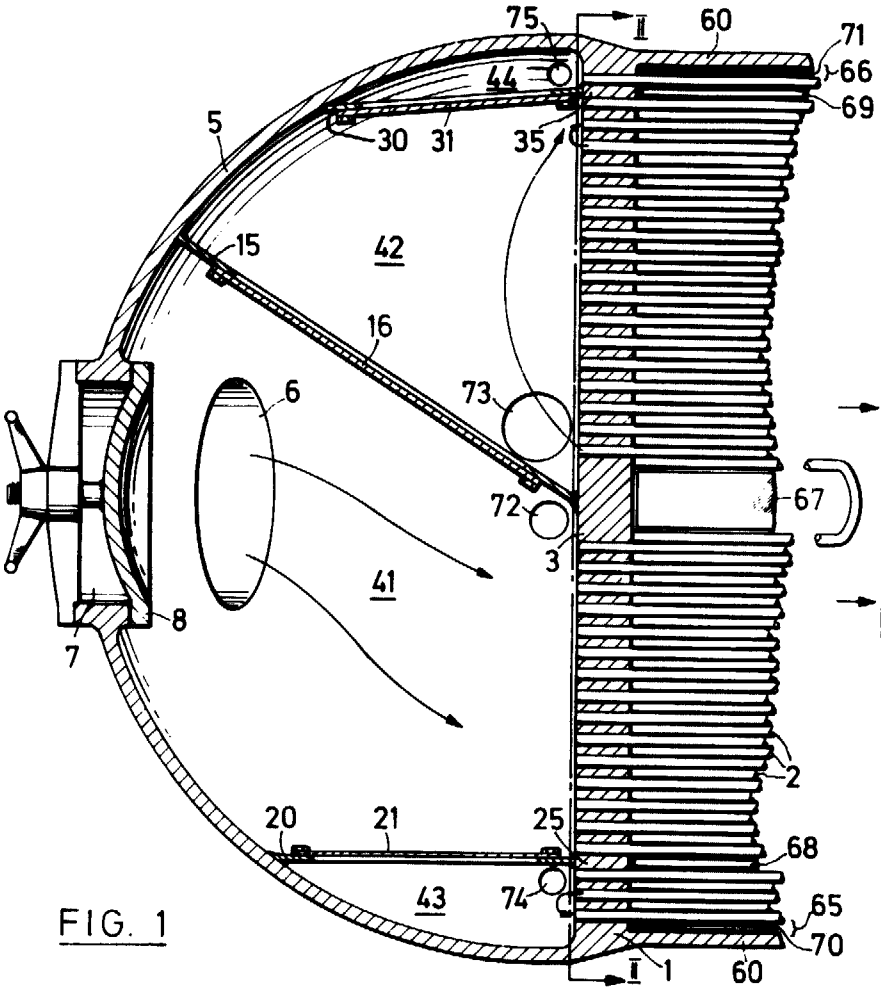

These and other objects and advantages of the invention will become more apparent from the following detailed description and appended claims taken in conjunction with the accompanying drawing in which:

FIG. 1 illustrates a horizontal sectional view through a lower part of a heat-exchanger according to the invention; and FIG. 2 illustrates a view taken on line II—II of FIG. 1.

Referring to FIG. 1, the heat exchanger is horizontally disposed and has a housing formed, in part, by a cylindrical shell 60 across which a tube plate 1 is mounted to separate the housing into two sections. A plurality of horizontally disposed U-shaped tubes 2 are mounted at their ends in the tube plate 1 and are arranged in parallel groups so that at least some of the tubes are situated in one plane. As shown, the tubes 2 extend over a middle region 3 of the tube plate 1.

The housing also includes a hemispherical hood 5 which is integral with the shell 60 and is disposed in spaced relation to the tube plate 1. The hood 5 includes an inlet 6 for the delivery of a vaporized heat-containing medium, such as steam, as well as a manhole 7 for access to the hood interior. A manhole cover 8 of suitable construction is mounted to close the manhole 7.

A plurality of partitions namely three, 15, 20, 30 are connected between the hood 5 and the tube plate 1 to define four chambers 41, 42, 43, 44 within the hood 5. As shown, the middle partition 15 extends from a point on the hood 5 above the inlet to the middle region 3 of the tube plate 1. The middle chamber 41 is in communication with the inlet 6 and serves as an inflow-chamber for the heat-containing medium while another chamber 44 communicates via an outlet 75 in the hood 5 to exhaust the medium after condensing. The remaining chambers 42, 43 are intermediate of the inflow and outflow chambers 41, 44 relative to the flow of the heat-containing medium and serve as deflecting chambers for the flow of heat-containing medium. The inflow chamber 41 and the intermediate chambers 42, 43 are each formed with an outlet 72, 73, 74 for condensate as explained below. Each of these outlets 72, 73, 74, as the outlet 75, in the outflow chamber 44 is disposed in the lowest part of the respective chamber 41, 42, 43, 44.

Each partition 15, 20, 30 is secured as by welding to the tube plate 1 and the hood 5. Also, each is provided with an opening covered over by a removably mounted cover 16, 21, 31. As shown in FIG. 1, the covers 16, 21, 31 are secured in placed by bolts. Upon removal of the covers 16, 21, 31, the chambers 42, 43, 44 are rendered accessible via the chamber 41 and manhole 7.

The shell 60 as indicated in FIG. 2 is provided on the underside with a suitable inlet 61 for a heat-absorbing medium, i.e. a medium to be heated. The upperside (not shown) of the shell 60 is provided with an outlet for this medium.

A spacer 67 is disposed in alignment with the middle region 3 of the tube plate 1 within the space defined by the tubes 2. In a similar fashion, spacers 68, 69 are disposed within the shell 60 in passageways formed in the regions 25, 35 of the tube plate 1 where the partitions 20, 30 are welded. Similar spacers 70, 71 are also positioned in the end regions 65, 66 between the shell 60 and tubes 2.

The tube plate 1 is divided into four fields 51, 52, 53, 54 by the regions 3, 25, 35, each of these fields has a different number of tube-ends therein. For example, the number of tube-ends follow the format:

| Field No. | No. of Tube-Ends |
|---|---|
| 51 | 1459 |
| 52 | 1551 |
| 53 | 97 |
| 54 | 5 |

Thus, three tube groups of different sizes are formed, i.e. tube group A comprises 1459 tubes which run from field 51 into field 52; tube group B comprises 92 tubes which run from field 52 into field 53 and tube group C comprises 5 tubes which run from field 53 into field 54.

In operation, a heat-containing medium in vaporized form passes into inflow chamber 41 via inlet 6. Any condensate in the medium falls to the bottom and drains out of the outlet 72. The vaporized medium then enters into the tube end in field 51 and flows through the tubes 2 of tube group A into the intermediate chamber 42 via the tube ends in field 52. During , this time, a heat-absorbing medium is passed into the shell 60 via the inlet 61 and flows around the tubes 2 in heat exchange relation. As a result, a part of the heat-containing medium in the tube group A condenses and is carried into the chamber 42. The condensate then falls to the bottom of the chamber 42 and drains through the outlet 73 while the remaining vaporized heat-containing medium enters into the tube ends of tube group B in field 52. The medium then passes through these tubes into the field 53 and enters the intermediate chamber 43. Any condensate in the chamber 43 then drains via the outlet 74 while the vaporized medium passes into the tube ends of tube group C in the field 53 and flows through the tube group C into the outlet chamber 44. The condensate forming in the tube group C flows into the chamber 44 and drains out of the outlet 75. Any excess vaporized medium in the chamber 44 also passes out of the outlet 75.

The deflecting chamber 42, 43 are relatively large to facilitate separation of the vaporized medium and condensate from one another.

Making the simplifying assumption that in all tubes, with the same quantity flowing through, the same quantity of steam becomes condensed, then with the aforesaid number of tubes, and with suitable temperature difference, tube-diameter and tube-length, there prevail in the tube groups for example the following conditions:

| Tube group | A | B | C |
|---|---|---|---|
| Number of tubes | 1459 | 92 | 5 |
| Inflowing quantity steam | 1.0 D | 0.063 D | 0.0093 D |
| Condensed quantity steam | 0.0937 D | 0.0591 D | 0.0032 D |
| Outflowing quantity steam | 0.063 D | 0.0093 D | 0.007 D |
| Inflow speed | v | v | 2.7 v |
| Outflow speed | 0.063 v | 0.147 v | 0.204 v |

As this table shows, the quantity of steam emerging from tube-group C, which represents a loss, in this example is only 0.7 permil, whereby the outflow speed from tube-group A is relatively low, being only 6.3 percent of the inflow speed.

There is also possible the following distribution of the 1556 tubes into three tube groups:

| Tube group | A | B | C |
|---|---|---|---|
| Number of tubes | 1233 | 266 | 57 |
| Inflowing quantity steam | 1 D | 0.2155 D | 0.0464 D |
| Condensed quantity steam | 0.7845 D | 0.1691 D | 0.0364 D |
| Outflowing quantity steam | 0.2155 D | 0.0464 D | 0.0100 D |
| Inflow speed | v | v | v |
| Outflow speed | 0.215 v | 0.215 v | 0.216 v |

As the table shows, the outflow speed from tube-group A amounts for example to 20 percent of the inflow speed however, the amount of steam lost has risen 10 permil.

With a distribution of the 1556 tubes so that the tube-group A has 1402 tubes, group B 140, and group C 14 tubes, the outflow speed from group A is 10 percent of the inflow speed, and the quantity of steam lost is 1 permil.

It is moreover possible, by dividing the 1566 tubes into four tube-groups, in spite of an increased outflow speed from the first tube-group, to reduce the amount of steam lost to 2.2 permil. Instead if using 1556 tubes, some other total quantity of tubes could be selected.

Instead of arranging a number of U-shaped tubes in one plane as above described, it would also be possible to use two or more sets of U-tubes, so as to obtain two or more zones at the tubes-plate covered by U-shaped tubes. However, such an arrangement is generally of no value.

What is claimed is:

1. A heat exchanger comprising a horizontally disposed housing having a hood at one end;

a tube plate mounted in said housing in spaced relation to said hood to separate said housing into two sections;

at least a pair of partitions connected between said hood and said tube plate to define at least three chambers within said hood;

an inlet in said hood in communication with a middle one of said chambers to deliver a heat-containing medium thereto;

an outlet in said hood in communication with a second of said chambers to exhaust the medium therefrom in at least condensed form; and a plurality of horizontally disposed U-shaped tubes mounted on said tube plate and extending away from said chambers, said tubes being disposed in at least one plane, a first portion of said tubes communicating said one chamber with a third of said chambers, and a second portion of said tubes communicating said third chamber with said second chamber, said second portion being of less number than said first portion.

2. A heat exchanger as set forth in claim 1 wherein said partitions extend at right angles to said plane of said tubes.

3. A heat exchanger as set forth in claim 1 wherein said third chamber has an outlet at the lowest point thereof for exhausting condensate therethrough.

4. A heat exchanger as set forth in claim 1 wherein said outlet of said second chamber is disposed at the lowest point thereof.

5. A heat exchanger as set forth in claim 1 which further comprises a manhole in said hood in the region of said one chamber, a removable cover over said manhole, an opening in each partition and a removable cover over each opening of said partitions

6. A heat exchanger comprising a horizontally disposed housing having a hood at one end;

a tube plate mounted in said housing in spaced relation to said hood to separate said housing into two sections;

three partitions connected between said hood and said tube plate defining four chambers within said hood;

an inlet in said hood in communication with a middle one of said chambers to deliver a vaporized heat-containing medium thereto;

an outlet in said hood in communication with a second of said chambers to exhaust the medium therefrom in at least condensed form; and a plurality of horizontally disposed U-shaped tubes mounted on said tube plate and extending away from said chambers, a first portion of said tubes communicating said one chamber with a third of said chambers, a second portion of said tubes communicating said third chamber with a fourth of said chambers, and a third portion of said tubes communicating said fourth chamber with said second chamber, said second portion being of less number than said first portion and said third portion being of less number than said second portion.

7. A heat exchanger as set forth in claim 6 further having an inlet in said housing on a side of said tube plate opposite said hood for introducing a medium to be heated and an outlet on said side for exhausting of the heated medium after passing over said tubes.

8. In a heat exchanger, the combination of a tube plate separating two sections of the heat exchanger from each other;

at least a pair of partitions in one of said sections dividing said one section into at least three chambers;

an inlet to a middle one of said chambers to deliver a vaporized heat containing medium thereto;

an outlet to a second of said chambers to exhaust the medium therefrom in at least condensed form; and a plurality of horizontally disposed U-shaped tubes in the other of said sections mounted on said tube plate and extending away from said chambers, a first portion of said tubes communicating said one chamber with a third of said chambers, and a second portion of said tubes communicating said third chamber with said second chamber, said second portion being of less number than said first portion.

9. In a heat exchanger as set forth in claim 8, said tubes being disposed in a plurality of parallel planes with said partitions extending substantially at right angles thereto.

* * * * *